US008668069B1

(12) United States Patent
Everhart

(10) Patent No.: US 8,668,069 B1
(45) Date of Patent: Mar. 11, 2014

(54) DIFFERENTIAL DETECTION COIN DISCRIMINATION SYSTEMS AND METHODS FOR USE WITH CONSUMER-OPERATED KIOSKS AND THE LIKE

(71) Applicant: Coinstar, Inc., Bellevue, WA (US)

(72) Inventor: Daniel D. Everhart, Edmonds, WA (US)

(73) Assignee: Outerwall Inc., Bellevue, WA (US)

( * ) Notice: Subject to any disclaimer, the term of this patent is extended or adjusted under 35 U.S.C. 154(b) by 0 days.

(21) Appl. No.: 13/691,047

(22) Filed: Nov. 30, 2012

(51) Int. Cl.
*G07D 7/00* (2006.01)

(52) U.S. Cl.
USPC ..... 194/302; 194/317; 194/318; 194/319; 194/320

(58) Field of Classification Search
USPC ..... 194/302–341
See application file for complete search history.

(56) References Cited

U.S. PATENT DOCUMENTS 4,667,093 A * 5/1987 MacDonald ..... 250/223 R
5,433,310 A * 7/1995 Bell ..... 194/318
5,503,262 A * 4/1996 Baudat et al. ..... 194/206
5,620,079 A 4/1997 Molbak
5,715,926 A * 2/1998 Furneaux et al. ..... 194/317
6,223,878 B1 * 5/2001 Cattani et al. ..... 194/317
6,494,776 B1 12/2002 Molbak
7,520,374 B2 4/2009 Martin et al.
7,584,869 B2 9/2009 DeLazzer et al.
7,653,599 B2 1/2010 Doran et al.
7,748,619 B2 7/2010 Martin et al.
7,815,071 B2 10/2010 Martin et al.
7,865,432 B2 1/2011 Doran et al.
7,874,478 B2 1/2011 Molbak
8,024,272 B2 9/2011 Doran et al.
2001/0013458 A1 * 8/2001 Sugata ..... 194/317
2006/0151284 A1 * 7/2006 Howells ..... 194/317
2007/0240967 A1 * 10/2007 Martin et al. ..... 194/317
2008/0000751 A1 * 1/2008 Ohtomo ..... 194/317
2011/0042403 A1 2/2011 Martin
2011/0209967 A1 * 9/2011 Toji ..... 194/320

* cited by examiner

*Primary Examiner* — Jeffrey Shapiro
(74) *Attorney, Agent, or Firm* — Perkins Coie LLP

(57) ABSTRACT

Systems and associated methods for coin discrimination are disclosed herein. In one embodiment, a method for discriminating coins includes obtaining an electromagnetic sensor signal of a coin, generating a contour signal by digitizing the sensor signal, identifying an active interval in the contour signal by eliminating the segments of the contour signal which are close to zero, and detecting the coin approach, pivot and departure points (coin features) from the contour signal in the active interval. The coin features can be compared to known values for different coins to discriminate the coin.

46 Claims, 15 Drawing Sheets

| | A | B | C | D | E | F | G | H | I | J | K | L | M | N | O | P | Q |
|---|---|---|---|---|---|---|---|---|---|---|---|---|---|---|---|---|---|
| 1 | repetition | | * | 1 | + | * | 1 | * | 1 | ** | | * | 1 | * | + | * | 1 |
| 2 | proximity threshold (a) | | _ | _ | ⊙ | ⊙ | ⊙ | ⊙ | ⊙ | ⊙ | ⊙ | ⊙ | ⊙ | ⊙ | ⊙ | ⊙ | _ |
| 3 | trailing slope (b) | | ✗ | ✗ | ↗ | ↗ | ↗ | ↗ | ↗ | → | → | ↘ | ↘ | ↘ | ↘ | ✗ | ✗ |
| 4 | leading slope (f) | | ✗ | ↗ | ↗ | ↗ | ↗ | ↗ | → | → | ↘ | ↘ | ↘ | ↘ | ↘ | ✗ | ✗ |
| 5 | curvature (p,c,n) | | ✗ | ✗ | ◡ | — | ◠ | ◠ | ◠ | ◠ | ◠ | ◠ | ◠ | — | ◡ | ✗ | ✗ |
| 6 | segment coverge | | | | | | ├ | — | — | — | — | — | ┤ | | | | |
| 7 | pivot | | | | | | | | ∧ | ∧ | ∧ | | | | | | |
| 8 | loop for nearby coins | | │ | | └ | ··· | ··· | ··· | ··· | ··· | ··· | ··· | ··· | ··· | ··· | ┘ | │ |
| 9 | loop for separated coins | | └ | ··· | ··· | ··· | ··· | ··· | ··· | ··· | ··· | ··· | ··· | ··· | ··· | ··· | ┘ |

DIFFERENTIAL DETECTION COIN DISCRIMINATION SYSTEMS AND METHODS FOR USE WITH CONSUMER-OPERATED KIOSKS AND THE LIKE

TECHNICAL FIELD

The present technology is generally related to the field of consumer-operated kiosks and, more particularly, to the field of coin discrimination.

BACKGROUND

Various embodiments of consumer-operated coin counting kiosks are disclosed in, for example: U.S. Pat. Nos. 5,620,079, 6,494,776, 7,520,374, 7,584,869, 7,653,599, 7,748,619, 7,815,071, and 7,865,432; and U.S. patent application Ser. Nos. 12/758,677, 12/806,531, 61/364,360, and 61/409,050; each of which is incorporated herein in its entirety by reference.

Many consumer-operated kiosks, vending machines, and other commercial sales/service/rental machines discriminate between different coin denominations based on the size, weight and/or electromagnetic properties of metal alloys in the coin. With some known technologies, a coin can be routed through an oscillating electromagnetic field that interacts with the coin. As the coin passes through the electromagnetic field, coin properties are sensed, such as changes in inductance (from which the diameter of the coin can be derived) or the quality factor related to the amount of energy dissipated (from which the conductivity/metallurgy of the coin can be obtained). The results of the interaction can be collected and compared against a list of sizes and electromagnetic properties of known coins to determine the denomination of the coin. In other known technologies, a coin can be rolled along a predetermined path and the velocity of the coin or the time to reach a certain point along the path can be measured. The measured velocity or time is a function of the acceleration of the coin which, in turn, depends on the diameter of the coin. By comparing the measured time or velocity against the corresponding values for known coins, the denomination of the coin can be determined.

In some applications, however, the coins are closely spaced such that the velocity or interaction of a coin with the electromagnetic field is affected by the presence of another coin. As a result, coin counting mistakes may occur, resulting in possible losses for the kiosk operator. Accordingly, it would be advantageous to provide robust coin discrimination systems and methods that would work reliably for the coins that are spaced closely to other coins.

DETAILED DESCRIPTION

Figure 1A:
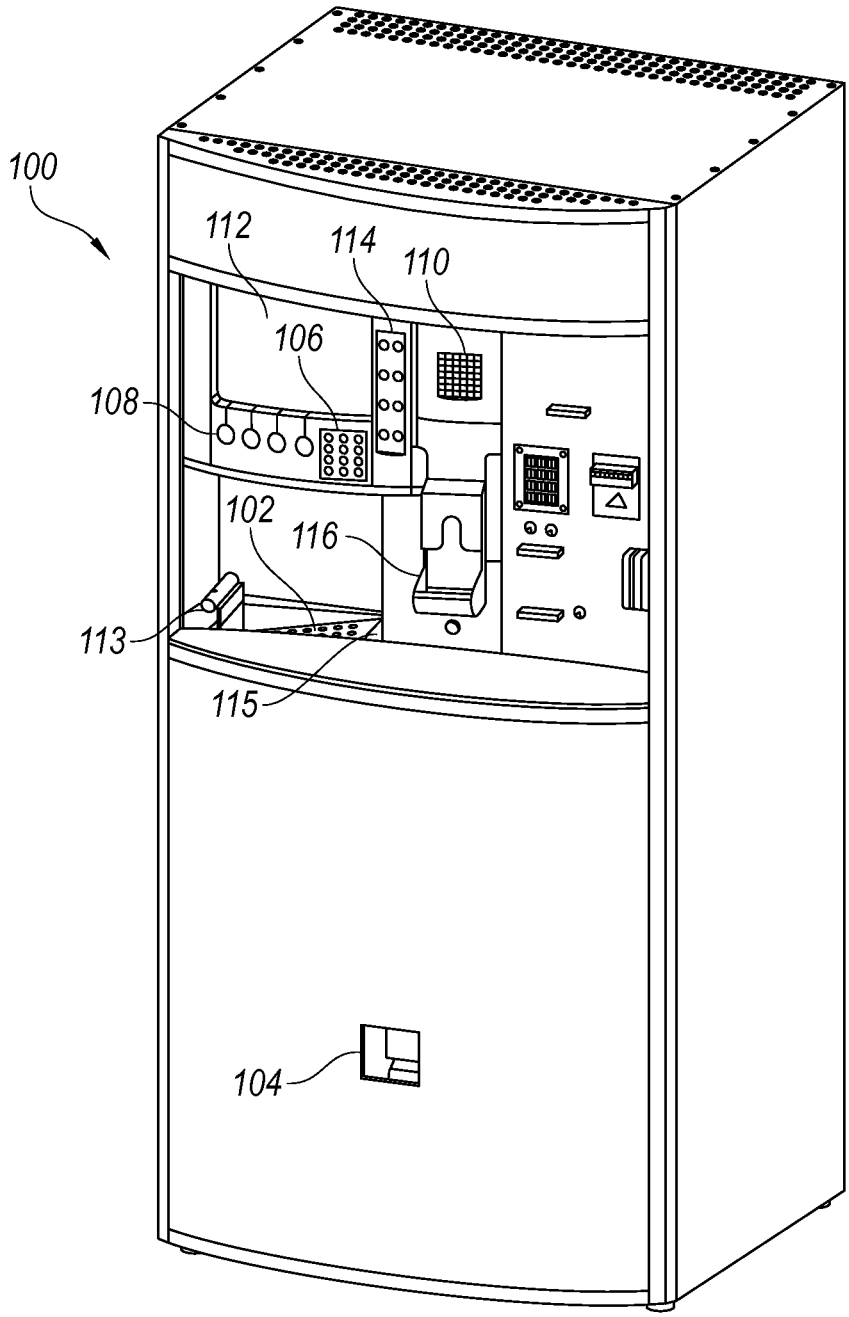
FIG. 1A is a front isometric view of a consumer-operated coin counting kiosk suitable for implementing embodiments of the present technologies.

The following disclosure describes various embodiments of systems and associated methods for discriminating coin denominations based on differential detection of the coins. In some embodiments of the present technology, a consumer-operated kiosk (e.g., a consumer coin counting machine, prepaid card dispensing/reloading machine, vending machine, etc.) includes an electromagnetic sensor that can produce one or more electrical signals as a coin passes by the electromagnetic sensor. In some embodiments, the electromagnetic sensor operates at two frequencies (low and high) to produce a total of four signals representing: low frequency inductance (LD), low frequency resistance (LQ), high frequency inductance (HD) and high frequency resistance (HQ). These signals can be functions of the coin size, metallurgy and speed. Additionally, the signals can be affected by the presence of other closely-spaced coins and by the noise and drift of the sensor. In some embodiments, the individual signals can be combined using digital or analog processing to produce a contour signal. For example, the two inductance signals (LD and HD) can be digitized, summed and filtered to produce a contour signal. In other embodiments, the low frequency inductance signal (LD) can be filtered to remove noise and then used as the contour signal. Other embodiments can use different combinations of the sensor signals, filtered or unfiltered, to produce a contour signal.

Depending on the number and frequency of the coins passing by the electromagnetic sensor, the signals may have some quiescent intervals, when the electromagnetic sensor outputs are near their baseline values, and some active intervals, indicating a proximity of one or more coins to the sensor. In some embodiments of the present technology, the quiescent intervals, i.e., the intervals when the contour signal intensity is lower than a certain threshold value, are ignored. Within the active intervals, different points of interest can be identified including, for example, the approach, pivot and departure points. In some embodiments, the approach and departure points can be defined as the inflection points in the contour, thus being identifiable by detecting a second derivative that is zero or close to zero. The pivot point can be identified as an extreme point within the active interval, thus being identifiable by detecting a first derivative that is zero or close to zero.

One advantage of identifying these points is their relatively low sensitivity to the presence of neighboring coins because, unlike with the conventional methods, the detection of the approach, pivot and/or departure points does not depend on a fixed offset from a particular starting point on the signal.

In some embodiments, the location and intensity of the approach, pivot and departure points, or other points in the signature, can be used to identify the coin using, for example, a look-up table of known coin features. Additionally, in some embodiments the relative distance between, for example, the approach/pivot or the pivot/departure points (i.e., a difference between the corresponding time stamps for these points) can be used to determine speed and/or acceleration of the coin which, in turn, can be used to operate electromechanical actuators to route the coin to the appropriate coin bin or chute. Based on the discrimination results, the coin can be properly credited or rejected by the consumer-operated kiosk.

Various embodiments of the inventive technology are set forth in the following description and FIGS. 1A-11. Other details describing well-known structures and systems often associated with coin counting machines, however, are not set forth below to avoid unnecessarily obscuring the description of the various embodiments of the disclosure.

Many of the details and features shown in the Figures are merely illustrative of particular embodiments of the disclosure and may not be drawn to scale. Accordingly, other embodiments can have other details and features without departing from the spirit and scope of the present disclosure. In addition, those of ordinary skill in the art will understand that further embodiments can be practiced without several of the details described below. Furthermore, various embodiments of the disclosure can include structures other than those illustrated in the Figures and are expressly not limited to the structures shown in the Figures.

FIG. 1A is an isometric view of a consumer coin counting machine 100 configured in accordance with an embodiment of the present disclosure. In the illustrated embodiment, the coin counting machine 100 includes a coin input region or tray 102 and a coin return 104. The tray 102 includes a lift handle 113 for moving the coins into the machine 100 through an opening 115. The machine 100 can further include various user-interface devices, such as a keypad 106, user-selection buttons 108, a speaker 110, a display screen 112, a touch screen 114, and a voucher outlet 116. In other embodiments, the machine 100 can have other features in other arrangements including, for example, a card reader, a card dispenser, etc. Additionally, the machine 100 can include various indicia, signs, displays, advertisements and the like on its external surfaces. The machine 100 and various portions, aspects and features thereof can be at least generally similar in structure and function to one or more of the machines described in U.S. Pat. No. 7,520,374, U.S. Pat. No. 7,865,432, and/or U.S. Pat. No. 7,874,478, each of which is incorporated herein by reference in its entirety. In other embodiments, the coin detection systems and methods disclosed herein can be used in other machines that count, discriminate, and/or otherwise detect or sense coin features. Accordingly, the present technology is not limited to use with the representative kiosk examples disclosed herein.

Figure 1B:
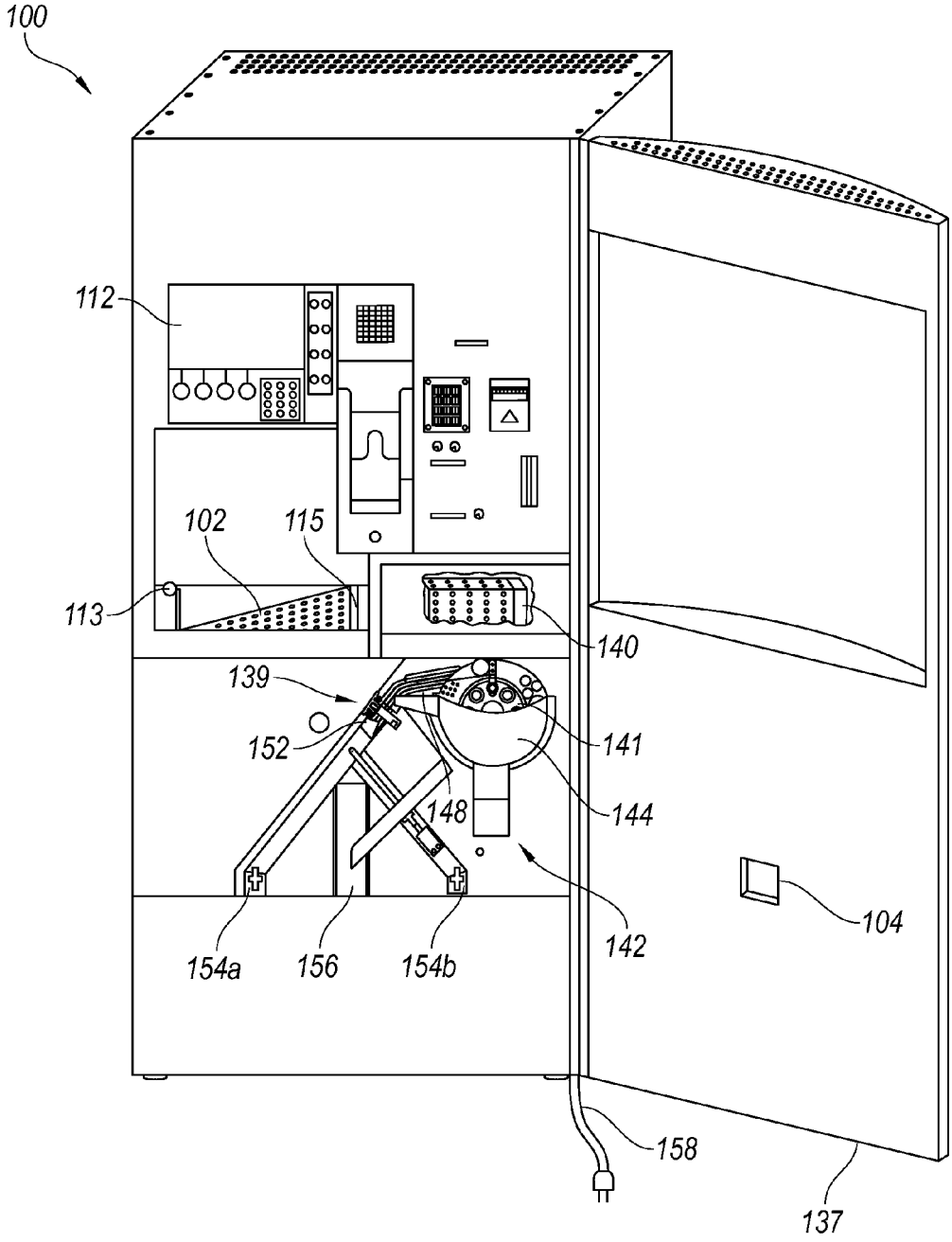
FIG. 1B is a front isometric view of the consumer-operated coin counting kiosk of FIG. 1A with a front door opened to illustrate a portion of the kiosk interior.

FIG. 1B is an isometric front view of an interior portion of the machine 100. The machine 100 includes a door 137 that can rotate to an open position as shown. In the open position, most or all of the components of the machine 100 are accessible for cleaning and/or maintenance. In the illustrated embodiment, the machine 100 can include a coin cleaning portion (e.g., a drum or trommel 140) and a coin counting portion 142. As described in more detail below, coins that are deposited into the tray 102 are directed through the trommel 140 and then to the coin counting portion 142. The coin counting portion 142 can include a coin rail 148 that receives coins from a coin hopper 144 via a coin pickup assembly 141.

In operation, a user places a batch of coins, typically of different denominations (and potentially accompanied by dirt, other non-coin objects and/or foreign or otherwise non-acceptable coins) in the input tray 102. The user is prompted by instructions on the display screen 112 to push a button indicating that the user wishes to have the batch of coins counted. An input gate (not shown) opens and a signal prompts the user to begin feeding coins into the machine by lifting the handle 113 to pivot the tray 102, and/or by manually feeding coins through the opening 115. Instructions on the screen 112 may be used to tell the user to continue or discontinue feeding coins, to relay the status of the machine 100, the amount of coins counted thus far, and/or to provide encouragement, advertising, or other messages.

One or more chutes (not shown) direct the deposited coins and/or foreign objects from the tray 102 to the trommel 140. The trommel 140 in the depicted embodiment is a rotatably mounted container having a perforated-wall. A motor (not shown) rotates the trommel 140 about its longitudinal axis. As the trommel rotates, one or more vanes protruding into the interior of the trommel 140 assist in moving the coins in a direction towards an output region. An output chute (not shown) directs the (at least partially) cleaned coins exiting the trommel 140 toward the coin hopper 144.

Figure 2A:
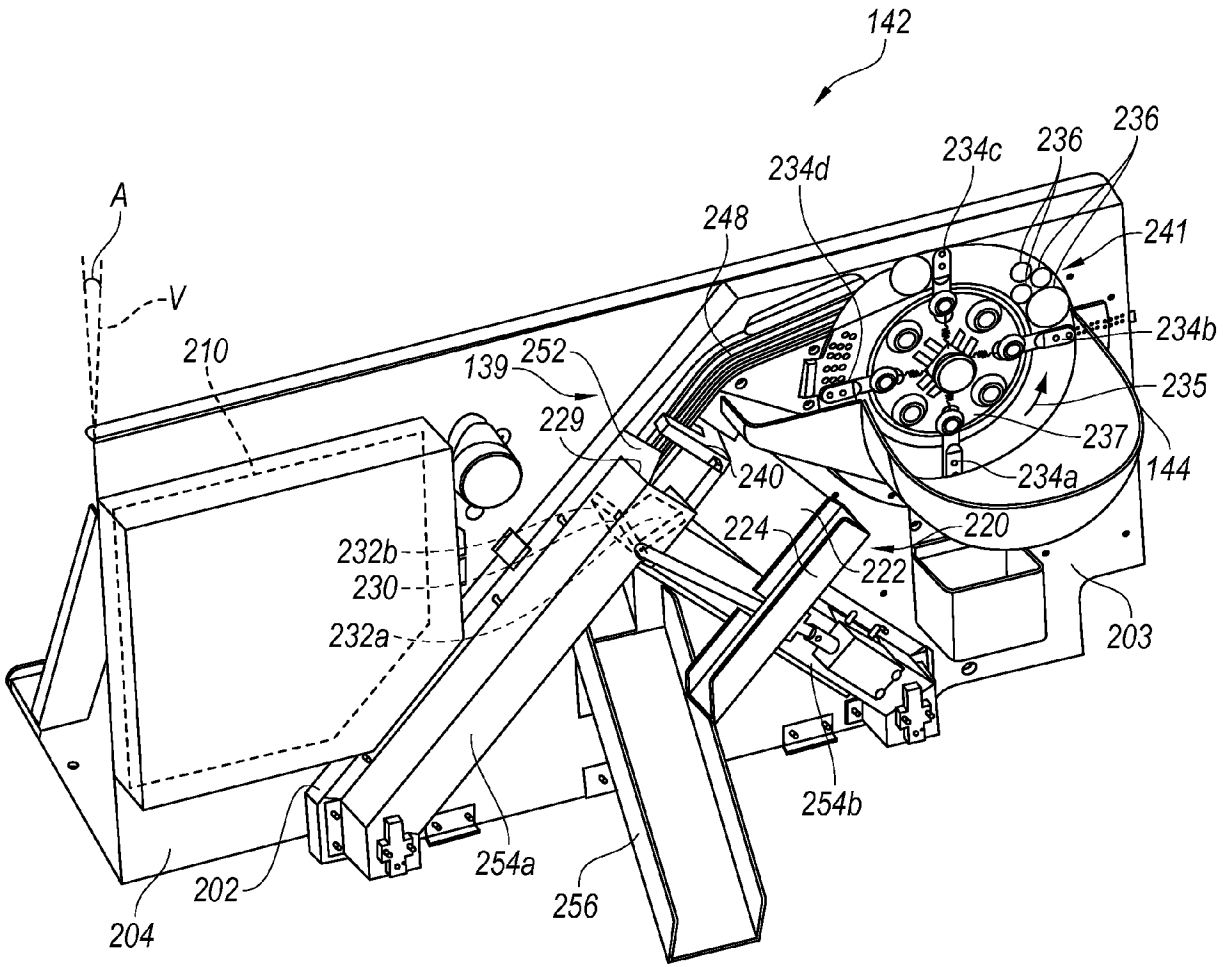
FIG. 2A is an enlarged front isometric view of a coin counting system of the kiosk of FIG. 1A.

FIG. 2A is an enlarged isometric view of the coin counting portion 142 of the coin counting machine 100 of FIG. 1B illustrating certain features in more detail. Certain components of the coin counting portion 142 can be at least generally similar in structure and function to the corresponding components described in U.S. Pat. No. 7,520,374. The coin counting portion 142 includes a base plate 203 mounted on a chassis 204. The base plate 203 can be disposed at an angle A with respect to a vertical line V from about 0° to about 15°. A circuit board 210 for controlling operation of various coin counting components can be mounted on the chassis 204.

The illustrated embodiment of the coin counting portion 142 further includes a coin pickup assembly 241 having a rotating disk 237 with a plurality of paddles 234*a*-234*d* disposed in the hopper 266. In operation, the rotating disk 237 rotates in the direction of arrow 235, causing the paddles 234 to lift individual coins 236 from the hopper 266 and place them on the rail 248. The coin rail 248 extends outwardly from the disk 237, past a sensor assembly 240 and further toward a chute inlet 229. A bypass chute 220 includes a deflector plane 222 proximate the sensor assembly and configured to deliver oversized coins to a return chute 256. A diverting door 252 is disposed proximate the chute entrance 229 and is configured to selectively direct discriminated coins toward a flapper 230 that is operable between a first position 232*a* and a second position 232*b* to selectively direct coins to a first delivery tube 254*a* and a second delivery tube 254*b*, respectively.

The majority of undesirable foreign objects (dirt, non-coin objects, etc.) are separated from the coin counting process by the coin cleaning portion or the deflector plane 222. However, coins or foreign objects of similar characteristics to desired coins are not separated by the hopper 266 or the deflector plane 222, and can pass through the coin sensor assembly 240. The coin sensor and the diverting door 252 operate to prevent unacceptable coins (e.g., foreign coins), blanks, or other similar objects from entering the coin tubes 254 and being kept in the machine 100. Specifically, in the illustrated embodiment, the coin sensor and the associated electronics and software determine if an object passing through the sensor is a desired coin, and if so, the coin is "kicked" by the diverting door 252 toward the chute inlet 229. The flapper 230 is positioned to direct the kicked coin to one of the coin chutes 254. Coins that are not of a desired denomination, or foreign objects, continue past the coin sensor to the return chute 256. Coins within the acceptable size parameters pass through the coin sensor 240. As described in greater detail below, the associated software determines if the coin is one of a group of acceptable coins and, if so, the coin denomination is counted.

Figure 2B:
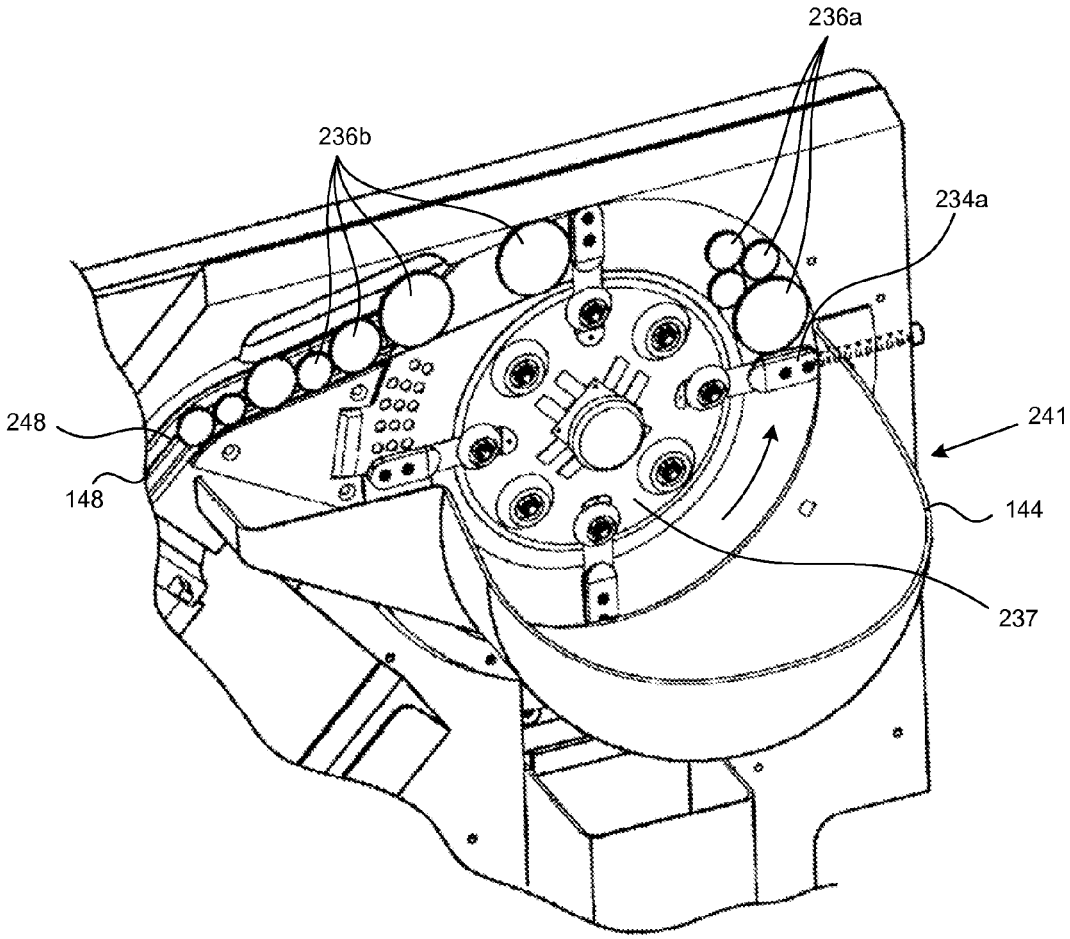
FIG. 2B is a partial isometric view of a coin pickup assembly of the coin counting system of FIG. 2A.

FIG. 2B is a partial isometric view of the coin pickup assembly 241 and the rail 248. As the rotating disk 237 rotates in the direction of arrow 235, the individual coins 236*a* are lifted from the hopper 266 and placed on the rail 248. The coins can separate to a file of coins 236*b*, where some coins may remain closely spaced as they pass by the coin sensor 240 downstream (not shown). In some cases, coins may even overlap as they pass by the coin sensor. As explained in relation to FIGS. 5 and 6, a close proximity or an overlap of the coins makes the coin detection with the conventional technologies more difficult.

Figure 3A:
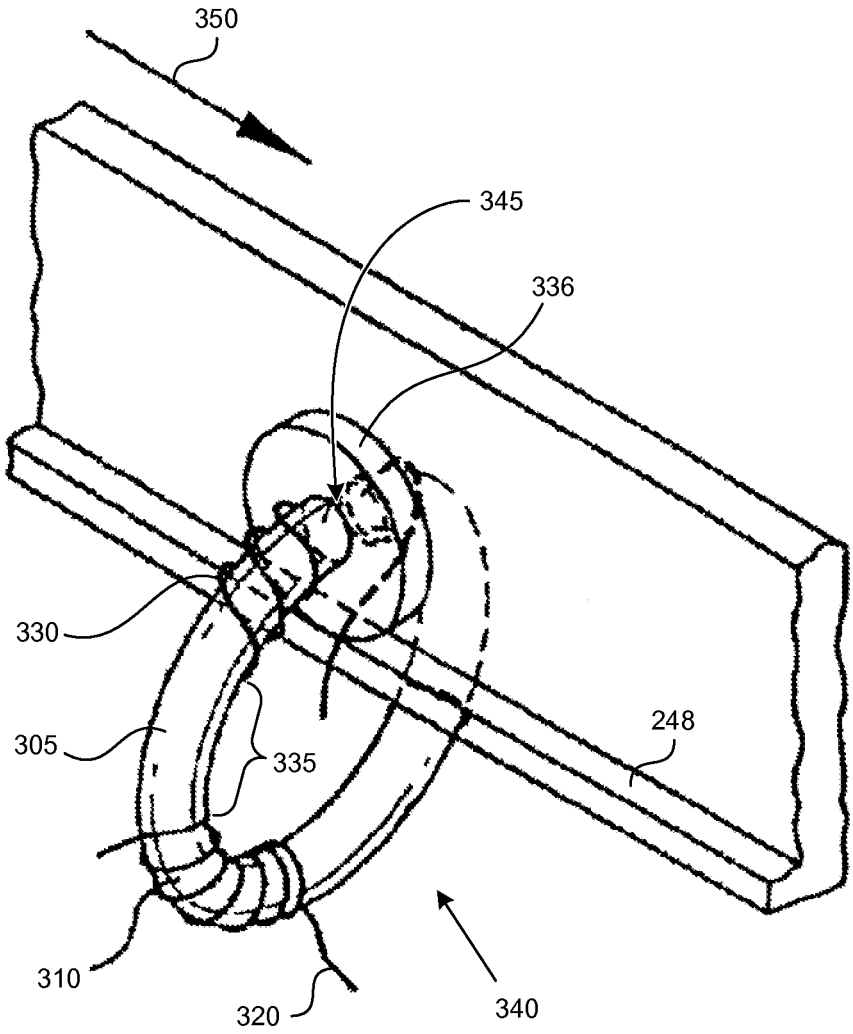
FIG. 3A is a partial isometric view of a coin sensor suitable for implementing embodiments of the present technologies.

FIG. 3A is an isometric view of a coin sensor 340 which may be included with the coin sensor assembly 240 of FIG. 2A. In the illustrated embodiment, the coin sensor 340 has a ferromagnetic core 305 and two coils: a first coil 320 and a second coil 330. The first coil 320 can be wound around a lower portion 310 of the sensor core 305 for driving a low frequency signal (Lf), and the second coil 330 can be wound around another region of the sensor core 305 for driving a high frequency signal (Hf). In the depicted embodiment, the second coil 330 (i.e., the high frequency coil) has a smaller number of turns and uses a larger gauge wire than the first coil 320 (i.e., the low frequency coil). Furthermore, the first coil 320 is positioned closer to an air gap 345 than the second coil 330 and is separated from the second coil 330 by a space 335 therebetween. Providing some separation between the coils is believed to help reduce the effect one coil has on the inductance of the other, and may reduce undesired coupling between the low frequency and high frequency signals.

When an electrical potential or voltage is applied to the first coil 320 and the second coil 330, a magnetic field is created in the air gap 345 and its vicinity. The interaction of a coin 336 or other object with the magnetic field yields data about the coin that can be used for coin discrimination, as described in more detail below. In one embodiment, a current in the form of a variable or alternating current (AC) is supplied to the first and second coils 320, 330. Although the form of the current may be substantially sinusoidal, as used herein "AC" is meant to include any variable wave form, including ramp, sawtooth, square waves, and complex waves such as wave forms which are the sum or two or more waveforms. As the coin 336 roles in a direction 350 along the coin rail 248, it approaches the air gap 345 of the sensor core 305. When in the vicinity of the air gap 345, the coin 336 can be exposed to a magnetic field which, in turn, can be significantly affected by the presence of the coin. As described in greater detail below, the coin sensor 340 can be used to detect changes in the electromagnetic field and provide data indicative of at least two different coin parameters of: the size and the conductivity of the coin 336. A parameter such as the size or diameter (D) of the coin 336 can be indicated by a change in inductance due to passage of the coin 336, and the conductivity of the coin 336 is (inversely) related to the energy loss (which may be indicated by the quality factor or "Q," representing a specific metallurgy of the coin 336). Therefore, in at least some embodiments both the low frequency coil 220 and high frequency coil 242 can each produce two signals (D and Q) for a total of four signals representing a particular coin.

Figure 3B:
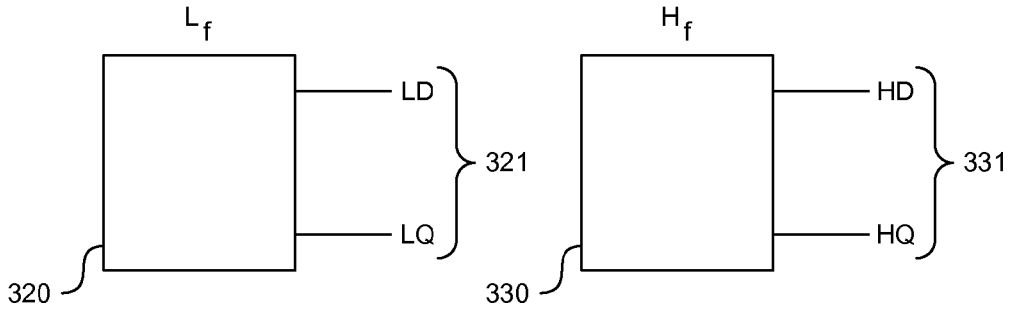
FIG. 3B is a schematic representation of outputs from the coin sensor of FIG. 3A.

FIG. 3B is a schematic representation of signals 321 produced by the low frequency coil 320 and signals 331 produced by the high frequency coil 330. The signal which is related to a change in inductance, and therefore to the coin diameter, is termed "D" (e.g., LD and HD). The signal from each coil which is related to the coin resistance/conductance, and thus to the metallurgy of the coin, is termed "Q" (e.g., LQ and HQ). Although the signal D is not strictly proportional to a diameter of a coin (being at least somewhat influenced by the value of signal Q) and although signal Q is not strictly and linearly proportional to the conductance (being somewhat influenced by the coin diameter), there is a sufficient relationship between signal D and coin diameter and between signal Q and coin conductance that these signals, when properly analyzed, can serve as a basis for coin discrimination based on the diameter and metallurgy of the coin.

Without wishing to be bound by any theory, it is believed that the response of signals Q and D is consistent, repeatable and distinguishable for the coin denominations over the range of interest for a coin-counting device. Many methods and/or devices can be used for analyzing signals D and Q, including visual inspection of an oscilloscope trace or a graph, automatic analysis using a digital or analog circuit and/or a computer based digital signal processing (DSP), etc. When using a computer, it is useful to precondition signals D and Q through suitable electronics, which can be at least generally similar in structure and function to the circuits described in U.S. Pat. No. 7,520,374, so as to have a voltage range and/or other parameters compatible with the inputs to a computer. In one embodiment, for example the preconditioned signals D and Q can be voltage signals within the range of 0 to +5 volts. The features of signals D and Q can be compared against the features corresponding to a known coin in order to identify a denomination of the coin.

Figure 4:
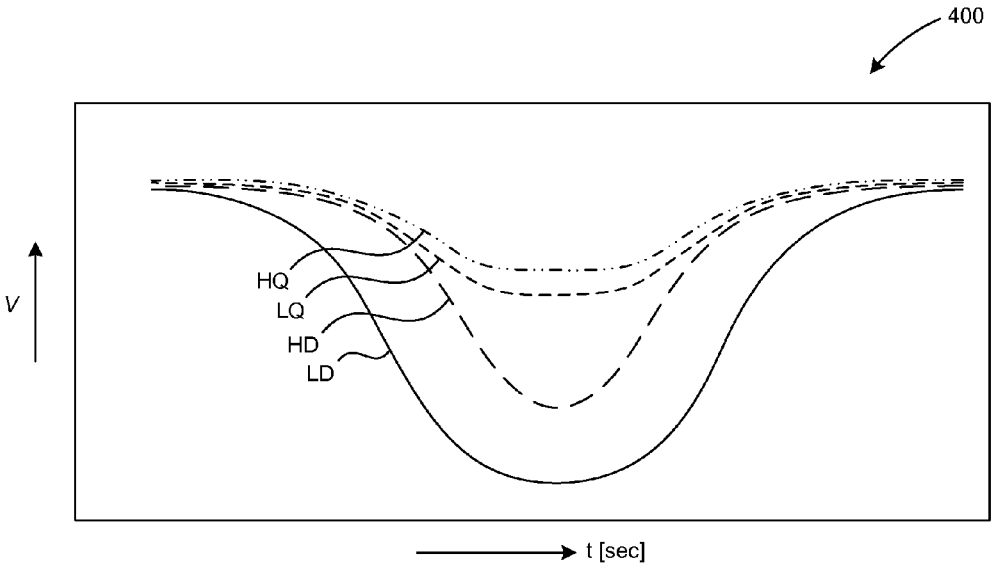
FIG. 4 is a graph of the coin sensor outputs of FIG. 3B.

FIG. 4 is a time/voltage graph illustrating a set of sensor signals 400 obtained by the interaction of a coin with the low and high frequency coils 320, 330, respectively, of the coin sensor 340 in FIG. 3A. As the coin passes by the coin sensor 340, each of the four signals (LD, LQ, HD and HQ) changes its value from a base voltage (close to zero) to a certain non-zero maximum offset, and then, as the coin leaves the air gap of the coin sensor, the voltage goes back to the base value close to zero volts. As explained above in relation to FIG. 3A, the signal deflections will depend on the coin size and metallurgy. Typically, the low frequency coil outputs (LD and LQ) produce signals with higher amplitude than the corresponding high frequency coil outputs (HD and HQ). Additionally, the signals related to the diameter of the coin (LD and HD) generally have higher amplitudes than the counterpart signals related to the conductance of the coin (LQ and HQ). Thus, a coin sensed by the coin sensor 340 may produce a set of signals having the amplitudes ranked from the smallest to the highest as: HQ, LQ, HD and LD. Different ranking of the signal amplitudes is also possible since the amplitudes depend at least partially on the gains of the circuit components. Furthermore, the widths of the signals (on the horizontal time axis) change with the speed of coin. A slower coin will spend more time within a sensing region of the coin sensor, resulting in wider signals when viewed against the time axis. Conversely, a faster coin having the same diameter and metallurgy will spend less time within the sensing region of the coin sensor, resulting in more narrow signals.

Figure 5:
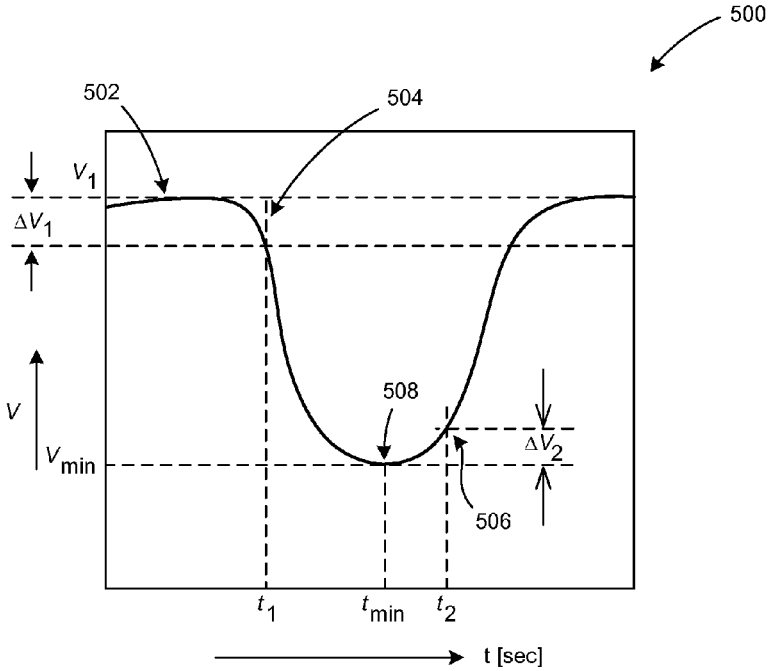
FIG. 5 is a schematic illustration of a prior art coin detection method.

FIG. 5 is a time/voltage graph illustrating conventional methods 500 for discriminating among coin denominations using a sensor signal 502 (i.e., LD, LQ, HD or HQ) from the coin sensor 340. One conventional method is a fixed-offset method that uses three parameters to discriminate among coin denominations: (1) a voltage drop $\Delta V_1$ from a generally constant voltage $V_1$, which represents a base state of the coin sensor (i.e., the voltage when the coin is not present), to a point 504 on the time/voltage graph, (2) a minimum voltage $V_{min}$, which corresponds to the minimum value 508 of the signal for a given sensor in the time interval of interest, and (3) a voltage rise $\Delta V_2$ from the voltage minimum to a point 506 on the time/voltage graph. The voltage drop $\Delta V_1$, minimum voltage $V_{min}$ and voltage rise $\Delta V_2$ have the corresponding time stamps $t_1$, $t_{min}$ and $t_2$, respectively. The voltage drop $\Delta V_1$ indicates that the sensor has detected the presence of coin. The value of the minimum voltage $V_{min}$ corresponds to a combination of size, metallurgy and structure of the coin. In general, the minimum voltage $V_{min}$ is recorded when the center of the coin is in the middle of the sensor. The voltage rise $\Delta V_2$ is a threshold which indicates that the coin has passed the center of the sensor. When the $V_{min}$ for the four sensor signals (i.e., LD, LQ, HD and HQ) are matched against the corresponding values for a known coin denomination, the coin is categorized and its value is logged accordingly. The associated time stamps $t_1$, $t_{min}$ and $t_2$ can be used to time the operation of the actuators that can place the coin to appropriate chute or bin. However, the fixed-offset method can be sensitive to the speed of the coin because the width of the sensor signal changes with the speed of the coin even for the coins of the same denomination. Additionally, the presence of a neighboring coin can distort the sensor signal, thus reducing the accuracy of the method, as further explained in relation to FIGS. 6A-6D below. Furthermore, the noise and drift of the sensor signal can further degrade accuracy of the above conventional methods.

Figure 6A:
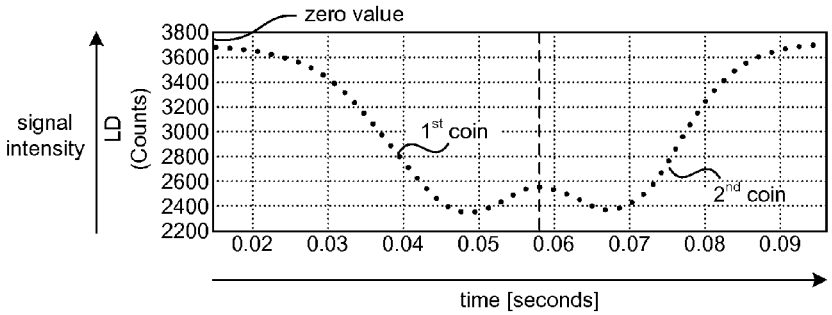
FIGS. 6A-6D are representative graphs showing a series of sensor signals for two closely spaced coins.
Figure 6B:
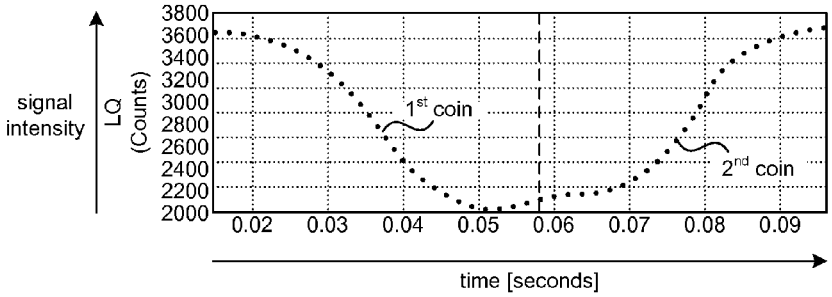
Figure 6C:
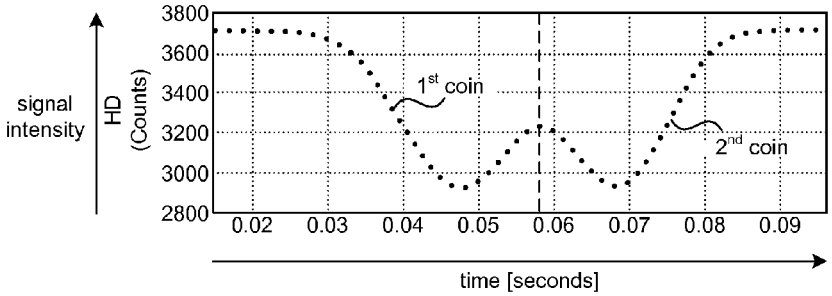
Figure 6D:
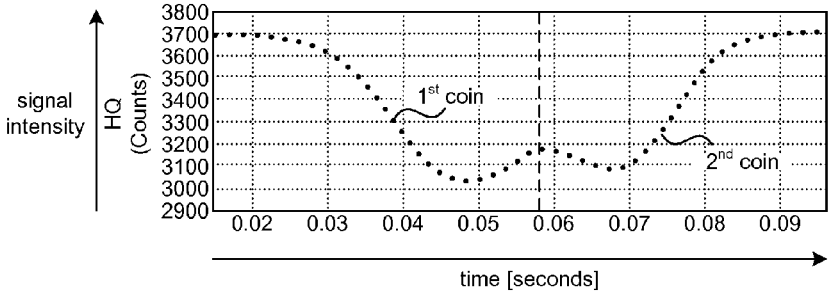

FIGS. 6A-6D are signal intensity vs. time graphs illustrating coin sensor outputs (LD, LQ, HD and HQ) for two closely spaced coins. Due to the close proximity of the two coins, it can be difficult to distinguish the coin sensor signals corresponding to each of the two coins. For example, FIG. 6B shows that the LQ signal does not have an appreciable local maximum following the passage of the first coin and prior to the arrival of the second coin. Therefore, it would be difficult to delineate the first coin signal from the second coin signal. Furthermore, none of the signals in FIGS. 6A-6D returns to its base value (i.e., the value of about 3700) before the sensor detects the presence of the second coin. This type of the sensor output would be difficult to resolve using the conventional fixed-offset technology described above with reference to FIG. 5, because the two closely spaced coins may be interpreted as a single, but wider coin.

Figure 6E:
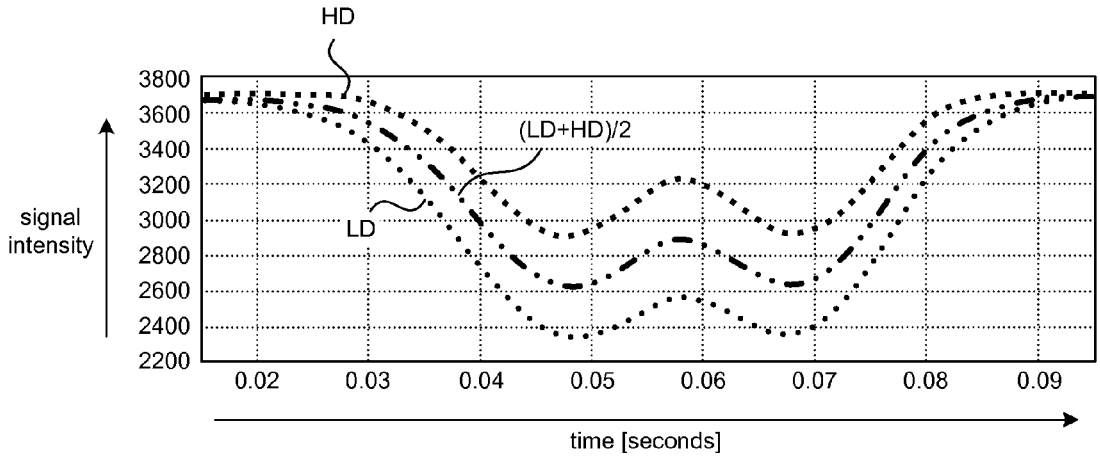
FIG. 6E is a graph of signal intensity vs. time for a combination of the coin sensor signals from FIGS. 6A-6D.

FIG. 6E is signal intensity vs. time graph for a combination of the coin sensor signals from FIGS. 6A-6D. Specifically, in some instances it may be beneficial to combine two or more sensor signals prior to further processing of the signals to, for example, highlight certain features or smooth signal noise in the signals. Thus, in FIG. 6E two coin sensor outputs, LD and HD are combined into (LD+HD)/2 signal, which can be used for the feature detection, as described below in relation to FIGS. 7-10. Other, linear or non-linear combinations of the sensor outputs are also possible.

Figure 7:
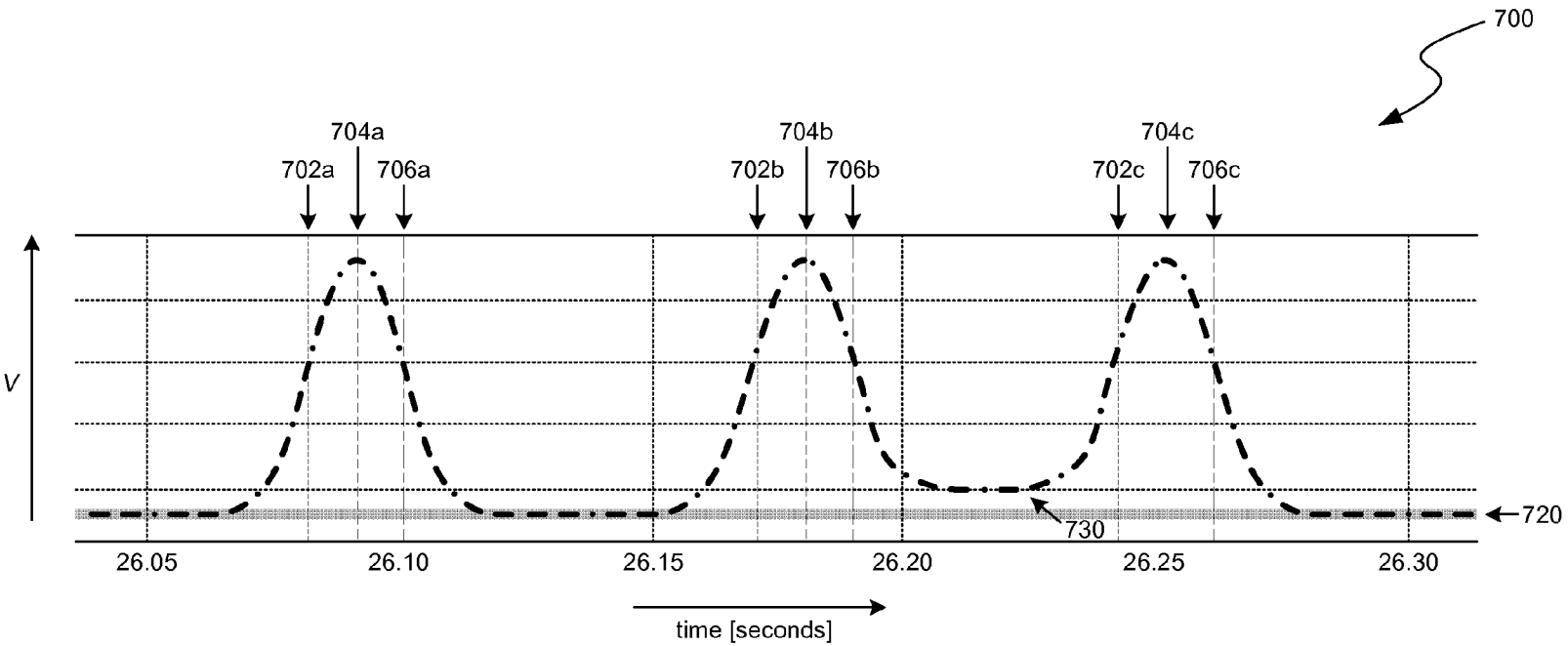
FIG. 7 is a representative graph illustrating sensor signals for several consecutive coins.

FIG. 7 is a voltage/time graph showing a coin discrimination method in accordance with an embodiment of the present technology. In the illustrated embodiments, a contour signal 700 is obtained by inverting the sensor signal (i.e., the presence of a coin at the coin sensor is shown as a voltage increase, not a voltage decrease). The contour signal can be filtered to remove signal noise. A person having ordinary skill in the art would know of many methods to electronically or digitally invert and filter a contour signal. Many digital filters can be used to remove noise from the contour signal including window based filters like, for example, a boxcar, a triangle, a Hanning or a Gaussian filter. By way of example, the contour signal 700 corresponds to three coins passing by a coin sensor such as the coin sensor 340, but the contour 700 signal can also be a segment of a longer signal obtained from the coin sensor. In the illustrated example, the total elapsed time is about 0.25 seconds (i.e., from about 26.05 seconds to about 26.3 seconds). The time lapse between passage of the first coin and the second coin is sufficiently long for the contour signal to reach its base value 720, whereas the time lapse between passage of the second coin and the third coin is not long enough for the contour signal to return to its base value. Instead, the contour signal 700 reaches a voltage 730 between the second and third coin, which is a higher voltage than the base voltage 720. For this reason, the conventional coin discrimination technology described with reference to FIG. 4 could have difficulties in discriminating these coins.

Several coin features can be detected with the contour signal 700 of FIG. 7, including coin approaches 702*a-c*, coin pivots 704*a-c* and coin departures 706*a-c*. The coin approach 702*a* (for the first coin) can be determined as a first inflection point in the contour signal and the coin departure 706*a* can be determined as a second inflection point in the contour signal 700. The maximum value of the contour signal between the corresponding first and second inflection points is a pivot point 704*a* (for the first coin). A coin discrimination method based on a combination of the approach, pivot and departure points in accordance with the present technology can be more robust because, for example, such a method does not depend on a complete return of the contour signal to its base value as required by some conventional methods since the approach/pivot/departure points are present in the contour signal even if the contour signal does not return to its base value. Additionally, the coin speed can be estimated by knowing the time stamps of two signal features, such as the approach/departure points or approach/pivot points. The coin speed can be used to accurately time the flapper 230 (shown in FIG. 2A, downstream of the sensor 240) to selectively direct the coin to an appropriate delivery tube. Furthermore, coin acceleration can be determined knowing the approach, pivot and departure points. The coin acceleration can be used to further improve accuracy of the flapper 230 timing.

Figures 8A, 8B, 8C:
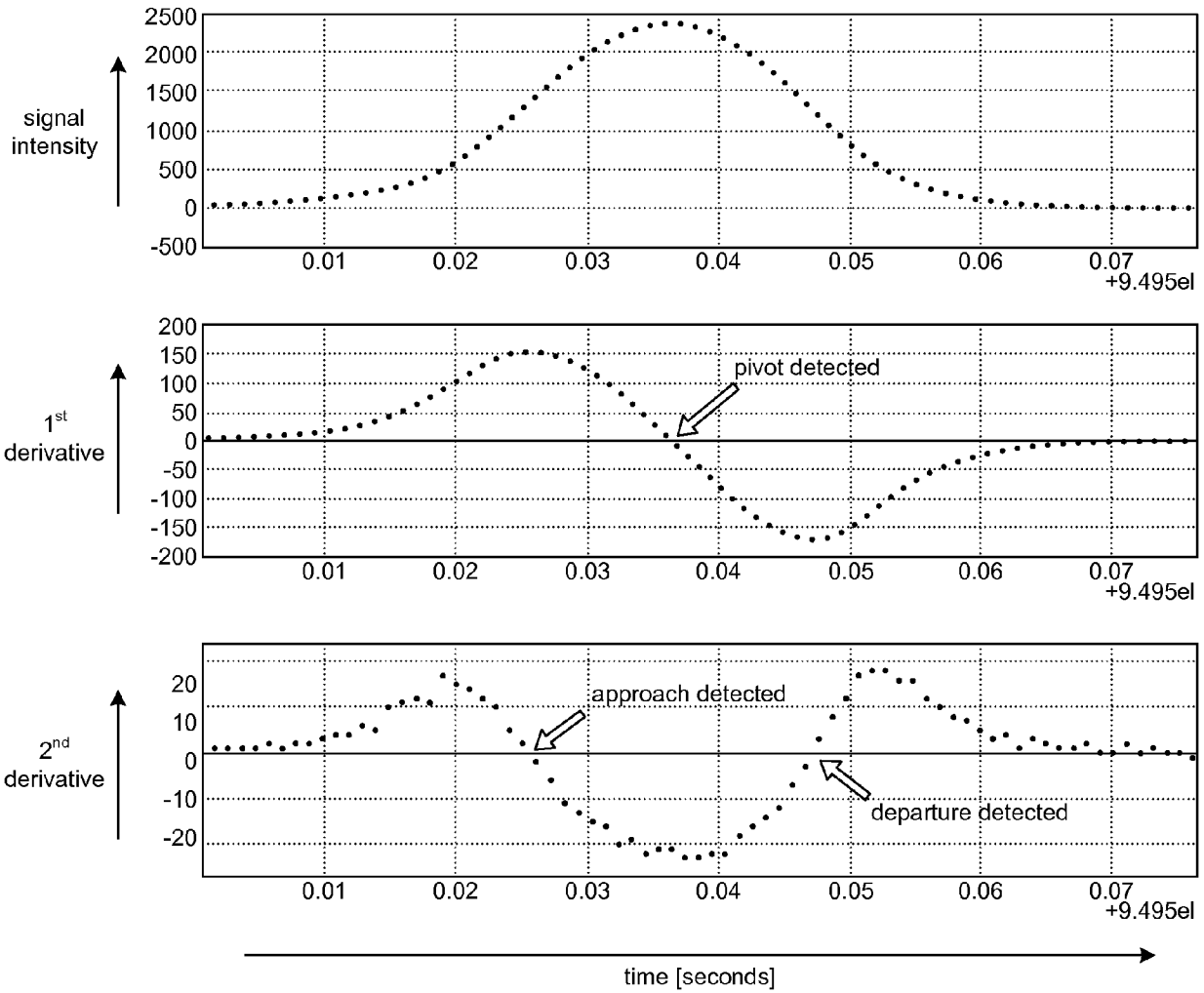
FIGS. 8A-8C illustrate a method of coin feature detection in accordance with an embodiment of the present technology.

FIGS. 8A-8C are a series of graphs illustrating detection of coin features in accordance with some embodiments of the present technology. FIG. 8A illustrates a contour signal obtained from an inverted sensor signal as a coin passes by the coin sensor. The contour signal can be filtered to remove the signal noise which, if not filtered, could produce false positives. Visual inspection of the graph in FIG. 8A indicates that the approach, pivot and departure points are present somewhere in the contour signal, but further signal processing is required for the accurate detection of these points and for the accurate placement of the points against a timeline. An example of such signal processing is given in FIGS. 8B and 8C as described below.

FIG. 8B is a graph of a first derivative of the contour signal shown in FIG. 8A. Here, the pivot point can be detected where the first derivative of the contour signal becomes zero or close to zero outside of the base voltage region. With a digital contour signal, it may be difficult to obtain a first derivative that is exactly equal to zero. Therefore, in some embodiments the pivot point can be declared if the first derivative has changed its value from a positive to a negative value. The pivot point corresponds to a maximum value of the contour signal, indicating that the coin is proximate to the center of the coin sensor.

FIG. 8C is a graph of a second derivative of the sensor signal shown in FIG. 8A. The approach and departure points correspond to the inflection points of the contour signal. Therefore, the approach and departure points can be identified as the points where the second derivative is zero or close to zero. Additionally, the approach and departure points can be identified if the second derivative of the contour signal changes its value from a positive to a negative value, or vice versa. The approach point is a point that precedes the pivot point on the time scale, whereas the departure point occurs after the pivot point. In some embodiments of the technology, the approach, pivot and departure points can be determined numerically from the contour signal shown in FIG. 7. For example, the first and second differentials can be calculated using a zeroth differential as:

$$\left.\begin{aligned} &\text{zeroth differential: } d_i^0 = g_i \\ &\text{first differential: } d_i^1 = d_i^0 - d_{i-1}^0 \\ &\text{second differential: } d_i^2 = d_i^1 - d_{i-1}^1 \end{aligned}\right\} \quad \text{Equation set 1}$$

where $g_i$ is a uniformly sampled signal. A person of ordinary skill in the art would know of several methods for calculating the derivatives of a discrete signal in addition to the backward finite difference method described in Equation set 1. For example, a forward or central finite difference method can also be used to calculate the derivatives. A candidate pivot point corresponds to the sensor signal having a first differential $d_i^1=0$. Candidate approach/departure points correspond to the points where $d_i^2=0$. As explained with respect to FIG. 7, the approach, pivot and departure points, and/or points located relative to them (e.g. the points in between) can be used to determine the coin denomination, and the coin speed and acceleration can be used for accurate delivery of the coin to the proper chute or bin.

Figure 9:
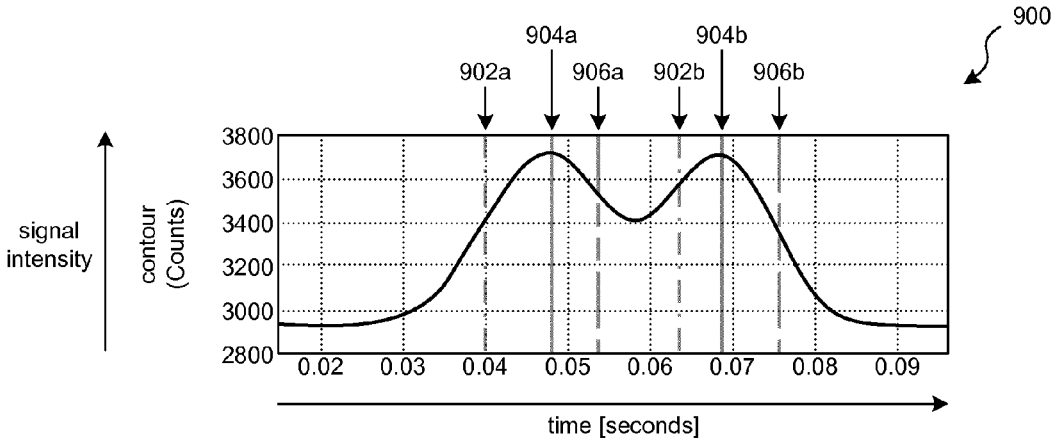
FIG. 9 is a schematic illustration of an arrangement of coin signals in accordance with an embodiment of the present technology.

FIG. 9 is a graph illustrating a contour obtained by sampling a sensor signal for two closely spaced coins. As shown in FIG. 4, the signal deflections are larger for the HD and LD signals than for the corresponding HQ and LQ signals. Also, the HD signal is typically narrower than the corresponding LD signal. Consequently, for two closely spaced coins, the HD signal produces a more pronounced peak value for separating the signal predominantly representing a first coin from the signal predominantly representing a second coin. Therefore, in at least some embodiments of the technology, including the embodiment illustrated in FIG. 9, the HD sensor signal is selected for further processing. The HD sensor signal shown in FIG. 9 has been inverted using the methods described in relation to FIG. 7. In other embodiments, another sensor signal (HQ, LQ or LD) or a combination of several signals can be selected for further processing.

In the sample contour signal illustrated in FIG. 9, the HD sensor signal is sampled more frequently to obtain better resolution of the contour signal, which improves the precision of subsequent data processing. One drawback of increasing the sampling rate is, however, the correspondingly higher requirement for data storage and processing speed. In some embodiments of the technology, the HD sensor signal can be sampled uniformly with other signals (i.e., LD, HQ and LQ) and then stored in memory or otherwise made available for further processing. Thus, the sampling in this case may look like: $\underline{\text{HD}}$-LD-HQ-LQ-$\underline{\text{HD}}$-LD-HQ-LQ, where the underlined samples ($\underline{\text{HD}}$) are further processed to detect the relevant features of the coin. In some embodiments, the HD sensor signal can be sampled more often than other signals. An example of such preferential sampling of the HD signal is: HD-LD-HD-HQ-HD-LQ-HD-HD-HD-LD-HD-HQ-$\underline{\text{HD}}$-LQ-$\underline{\text{HD}}$-HD-$\underline{\text{HD}}$. As before, the underlined samples ($\underline{\text{HD}}$) are used for further processing to detect the features of the contour signal. In other embodiments, sampled points from different sensor signals (e.g., HD and LD) can be combined into one contour signal for subsequent processing. One advantage common to both of the illustrated sampling schemes is that they also provide properly ordered signals for conventional coin detection methods. For example, since some conventional coin detection methods use a round robin sampling of the four coin sensor signals (e.g., HD-LD-HQ-LQ), the proper sequence of the coin sensor signals can be obtained from the overall data series above. Furthermore, such a sequence retains a uniform sampling frequency.

The contour 900 of FIG. 9 shows two groups of the approach/pivot/departure points, which may be difficult to distinguish using the numerical methods explained in relation to Equation set 1. For example, if the sole criteria for the detection of the approach point is that the second derivative is zero (or numerically very close to zero), then both the approach and departure points (e.g., 902*a* and 906*a*) would meet such criteria, making it difficult to determine which portions of the contour signal represent each of the two closely spaced coins. Therefore, in at least some embodiments of the technology the coin feature detection method explained above with reference to FIGS. 8A-8C can be further improved by analyzing some additional features of the contour signal including, for example, the slope and curvature that precedes, is current to, or trails one or more of the approach points (902*a*, 902*b*), pivot points (904*a*, 904*b*) and departure points (906*a*, 906*b*). These additional features of the contour signal can be determined from the following equations.

$$\left.\begin{aligned} &\text{proximity: } a_i = d_i^0 - T \\ &\text{trailing ("behind") slope: } b_i = d_i^1 \\ &\text{leading ("forward") slope: } f_i = d_{i+1}^1 \\ &\text{preceding curvature: } p_i = d_i^2 \\ &\text{current curvature: } c_i = d_{i+1}^2 \\ &\text{next curvature: } n_i = d_{i+2}^2 \end{aligned}\right\} \quad \text{Equation set 2}$$

where T is a signal threshold, typically close to zero. In other embodiments, the sign of the first derivative at the inflection point can be used to determine whether the inflection point is an approach point (the first derivative is positive for the sensor signal oriented as in FIG. 9) or a departure point (the first derivative is negative for the sensor signal oriented as in FIG. 9). In some embodiments of the technology, the sensor signals of interest can be pre-processed by isolating active intervals, which are the intervals of the sensor containing useful information about the coins. For example, the active intervals may contain those segments of the contour signals which are above a certain threshold, thus indicating the likely presence of a coin proximate the sensor. The threshold value T can be selected based on several criteria. For example, the sensor signals from the smallest coin in the markets of interest can be collected (e.g., the dime in the US market or the Euro 0.01 in the European market). Two signals can be combined to find the threshold T: (1) the maximum contour signal level detected when no coins are near the sensor, and (2) the minimum contour signal level among all the leading or trailing edges for the smallest coin. The threshold T can be estimated as a mean of these two levels.

In some other embodiments, the threshold T can be estimated by collecting a large number of samples from the contour signal when no coin is present, i.e., when the signal is quiescent. The threshold T can be calculated as a multiple of standard deviation ($\sigma$) of the quiescent signal ($\bar{x}$). For example, for a typical field installation of a coin counting machine, choosing the threshold $T=\bar{x}+6\sigma$ would result in underestimating the threshold less than once a day. Additionally and alternatively, the threshold value could be chosen as a value based on experience, and then tested and adjusted if needed.

Using the features calculated by Equation set 2, the approach/pivot/departure points can be determined based on the following Boolean logic:

approach (segment starts): $i_{arrivals}\{i:(a_i>0)\hat{}(b_i>0)\hat{}(f_i>0)\hat{}(c_i<0)\hat{}(p_i\geq 0)\}$ departure (segment ends): $i_{departures}\{i: (a_i>0)\hat{}(b_i<0)\hat{}(f_i<0)\hat{}(c_i<0)\hat{}(n_i\geq 0)\}$ pivot: $i_{pivots}\{i:(a_i>0)\hat{}(b_i>0)\hat{}(f_i\leq 0)\hat{}(c_i<0)\}$ For example, the approach may be declared when all of the following conditions are met: proximity (ai) is higher than zero, meaning that this segment of the contour signal indeed indicates a presence of a coin; trailing slope (bi) is higher than zero, meaning that the signal strength increases prior to the point of analysis; leading slope (fi) is higher than zero, meaning that the signal strength further increases past the point of analysis; the current curvature (ci) is negative, meaning that the curvature is concave; and the preceding curvature (pi) is positive or zero, meaning that in the preceding point the curvature is either convex or zero. When all these conditions are met for a point on the contour signal, that point corresponds to the approach point. The application of the corresponding Boolean expressions analysis to the departure and pivot points is omitted here for brevity. The above Boolean expressions can be coded in computer software for automatic approach/pivot/departure detection for a coin. As explained in relation to FIG. 7, the coin denomination, speed and acceleration can also be determined based on the approach, pivot and departure of the coin.

Figure 10:
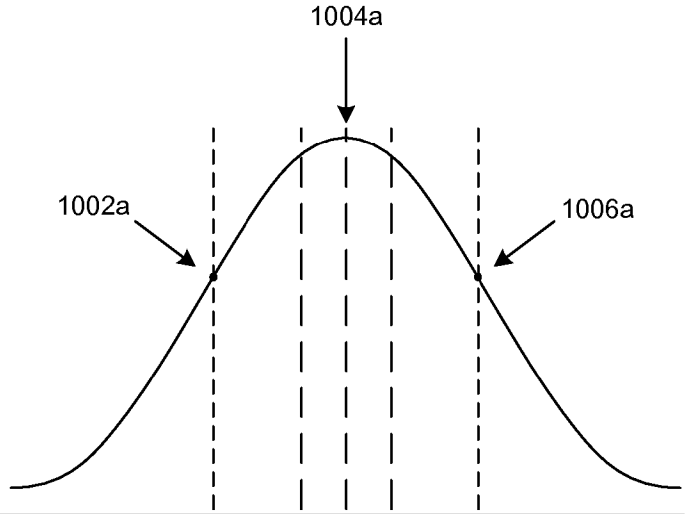
FIG. 10 illustrates a coin feature detection method in accordance with an embodiment of the present technology.

FIG. 10 shows another embodiment of the feature detection method in accordance with the present technology. Boolean logic shown in the table of FIG. 10 can be coded in a digital computer and applied against a contour signal to detect the coin features. The symbol key for the symbols in FIG. 10 is shown in Table 1 below. For example, the symbol ⊢ in cell G6 represents the coin approach, which may be detected when the conditions in column G above cell G6, i.e., the conditions in cells G1-G5, are met as follows: the proximity threshold is detected (cell G2=□); both trailing and leading slopes are positive (cells G3=↗ and G4=↗); and the curvature becomes concave (cell G3=⌒); but these conditions can only exist once (cell G1=1) for a given coin. The accompanying software can declare and time stamp a coin approach upon verifying that the above conditions are met. In another example, the symbol ∧ in cell I7 represents the coin pivot, which may be declared when the conditions in column I above cell I7 are met: the proximity threshold is detected (cell I2=□); the trailing slope is positive (cell I3=↗), while the leading slope is level (cell I4=→); the curvature is concave (cell I5=⌒); but these conditions can only exist once (cell I1=1) for a given coin.

Depending on the sampling resolution of the contour signal, it is possible to detect the pivot when both the trailing and leading slopes are flat as in cells J3/J4; and also when the trailing slope is flat (cell K2=→) and the leading slope is falling (cell K4=↘). Under either scenario, however, the pivot is detected only once for a given coin (cell I1=1). Rows 8 and 9 in FIG. 10 show that the search for nearby and separated coins is ongoing, but a detection of such additional coins would only occur outside of the segment defined by the first coin approach at the beginning of the segment and the departure of the first coin at the end of the segment. In some embodiments, the intensity of and the relative distance between the detected coin features can be compared against known values for the coins to properly discriminate the coins.

TABLE 1

Feature detection symbols

| Symbol key | |
|---|---|
| ✗ | don't care - any value is acceptable |
| | state repetitions |
| 1 | exactly once |
| * | zero or more times |
| + | one or more times |
| ** | optional block - any width, zero or more |
| | signal to threshold level |
| – | below threshold |
| Ω | above threshold |
| | signal slope |
| ↗ | rising |
| ↘ | falling |
| → | level |
| | signal curvature |
| ⌣ | upward |
| ⌒ | downward |
| — | flat |
| | state loops |
| ⌋ | last state in a loop - next state is either to the right or at the corresponding ⌊ |
| • • • | intermediate states in a loop |
| ⌊ | first state in a loop |
| | signal features detected |
| ⊢ | approach feature (segment begins) |
| — | interior of segment |
| ⊣ | departure feature (segment ends) |
| ∧ | pivot feature (coin center) |

Figure 11:
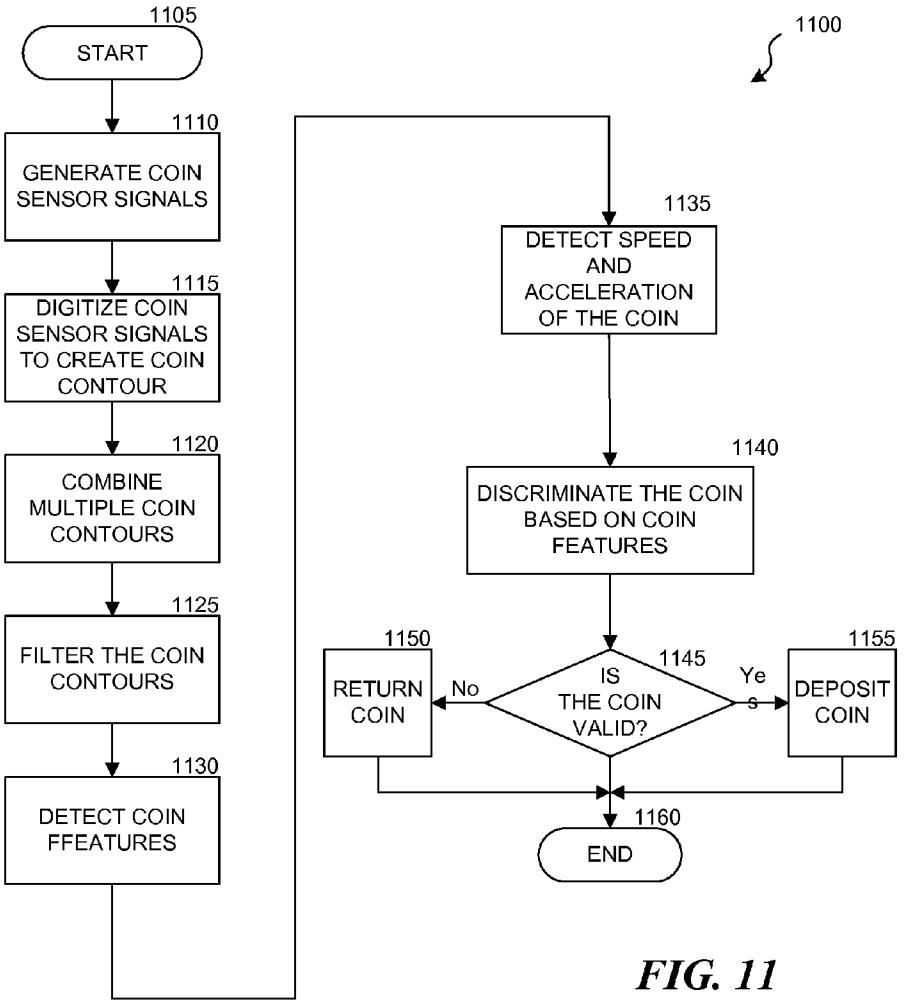
FIG. 11 is a flow diagram illustrating a routine for discriminating coins in accordance with an embodiment of the present technology.

FIG. 11 illustrates a flow diagram of a routine 1100 for discriminating coins in accordance with an embodiment of the present technology. The routine 1100 can be performed by one or more computers (e.g., a kiosk computer, a remote server, etc.) according to computer-readable instructions stored on various types of suitable computer readable media known in the art. The process flow 1100 does not show all steps for discriminating coins, but instead provides certain details to provide a thorough understanding of process steps for practicing various embodiments of the technology. Those of ordinary skill in the art will recognize that some process steps can be repeated, varied, omitted, or supplemented, and other (e.g., less important) aspects not shown may be readily implemented without departing from the spirit or scope of the present disclosure.

The process flow 1100 starts in block 1105. In block 1110, coin signals are acquired by a coin sensor. In some embodiments, the coin sensor can operate based on the changes in the electromagnetic field caused by the presence of the coin as described above. The coin sensor may produce several signals for the coin. In some embodiments, for example, the coin sensor has two coils operating at different frequencies, each coil producing two signals for a total of four sensor signals.

In block 1115, the coin signals can be digitized to create a coin contour. In some embodiments, the sensor signals can be digitized such that a select signal is oversampled for added precision and resolution in the feature detection. For example, in a sampling sequence HD-LD-HD-HQ-HD-LQ-HD-HD-HD-LD-HD-HQ-HD-LQ-HD-HD-HD the underlined samples can be used as the contour signal, resulting in a higher sampling rate in comparison to the non-underlined round-robin sequence LD-HQ-LQ-HD. An additional advantage of such a sampling is preservation of a sampling sequence suitable for conventional counting systems if desired.

In block 1120, the contour signals can be combined in a composite contour signal. In some embodiments, for example, the LD and HD contours can be combined. In block 1125, the contour signal can be filtered. Different suitable digital filtering algorithms are known to those of ordinary skill in the art. Some examples are the box-car, triangle, Gaussian and Hanning filters. In some embodiments, a combination of digital filters can be used to optimize or at least improve the results.

Having generated a contour signal, the coin features can be found from it in block 1130. The coin features of interest can be, for example, a coin approach (indicated by an inflection point in the coin contour), a coin pivot (indicated by a zero slope in the coin contour), and a coin departure (indicated by another inflection point in the coin contour, past the coin pivot point on the timeline). The coin features may be detected by examining relevant derivatives of the contour signal, including the zeroth, first, and second derivatives. Detection of the coin features of interest can be accomplished within the active zones by excluding the inactive zones of the contour signal from consideration. For example, a threshold contour signal can be established such that only the contour signal above the threshold is considered for the subsequent coin feature detection steps. Additionally, since the contour signal does not have to reach the threshold value between two consecutive coins, the features of the closely spaced or overlapping coins are detectable in at least some embodiments of the technology.

Once the approach, pivot and departure features of a coin are known, its speed and acceleration can be detected in block 1135. A person having ordinary skill in the art would know several methods for calculating the speed of a coin from the time it takes the coin to travel between at least two points on a trajectory and for calculating the acceleration of a coin from the time it takes the coin to traverse at least three points on its trajectory. Information about the speed and/or acceleration of the coin can be used to operate, for example, the electromechanical actuators in a coin counting machine to route the coin to a proper chute or bin.

In block 1140, one or more coin features (approach, pivot and/or departure) can be compared with known values for the applicable range of acceptable coins using, for example, a look-up table. When one or more coin features are matched against one or more known values, the coin denomination can be determined and the system can credit the coin accordingly. In block 1145, a decision is made about coin validity based on the discrimination results in block 1140. If the coin is determined to be valid in decision block 1145, the coin is deposited in block 1155. On the other hand, if the coin is determined to be not valid in block 1145, the coin is returned to the user in block 1150. The process of coin discrimination ends in block 1160, and can be restarted in block 1105 for the next coin.

Each of the steps depicted in the routine 1100 can itself include a sequence of operations that need not be described herein. Those of ordinary skill in the art can create source code, microcode, and program logic arrays or otherwise implement the disclosed technology based on the process flow 1100 and the detailed description provided herein. All or a portion of the process flow 1100 can be stored in a memory (e.g., non-volatile memory) that forms part of a computer, or it can be stored in removable media, such as disks, or hardwired or preprogrammed in chips, such as EEPROM semiconductor chips.

Figure 12:
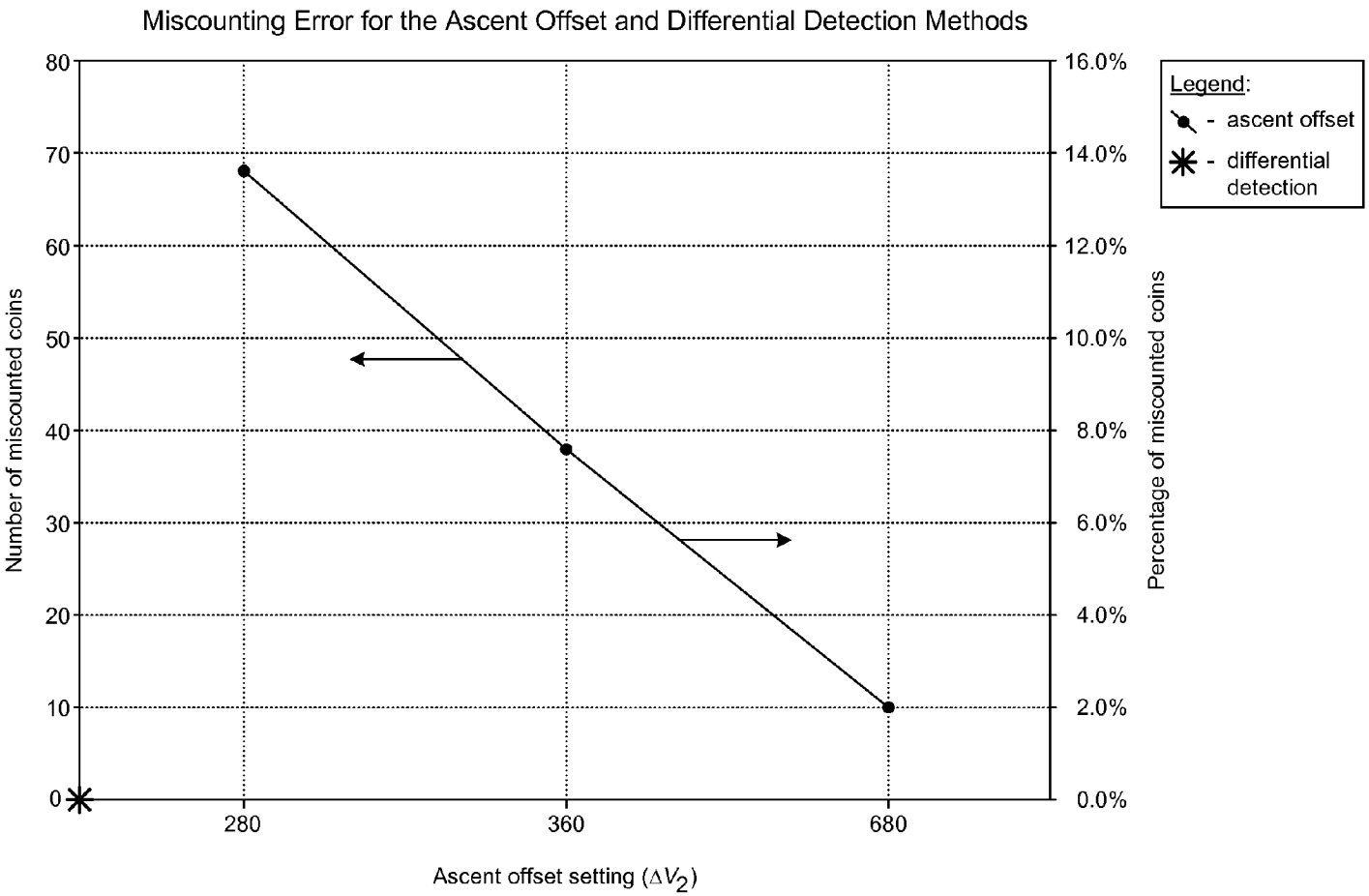
FIG. 12 illustrates sample coin discrimination results using the conventional and present technologies.

FIG. 12 is a graph of coin discrimination results obtained by the differential detection and the conventional ascent offset methods. Both methods were tested using a batch of 500 Euro one cent coins, because the small size of these coins makes them generally difficult for the discrimination methods. The ascent offset setting $\Delta V_2$ is plotted on the horizontal axis while the number and percentage of the miscounted coins is shown on the two vertical axis. The conventional ascent offset method used three ascent offsets $\Delta V_2$ (illustrated in FIG. 5): 280, 360 and 680, resulting in the error rates of 13.6%, 7.6% and 2%, respectively. With an increase in the $\Delta V_2$ setting the miscounting errors decrease for the conventional ascent offset method, but the magnitude of $\Delta V_2$ is in reality limited because an excessively high $\Delta V_2$ would result in undercounting large coins (not present in the test batch of 500 Euro one cent coins). Furthermore, even the 2% error rate may be unacceptably high in many applications. However, the differential detection method produced no miscounting errors with the same batch of coins.

From the foregoing, it will be appreciated that specific embodiments of the invention have been described herein for purposes of illustration, but that various modifications may be made without deviating from the spirit and scope of the various embodiments of the invention. For example, other signals in addition or instead of the four coin sensor signals (LD, HD, LQ, HQ) can be used. In some embodiments, the signals can be sampled at different frequencies and then numerically summed together using appropriate time offsets to create a contour signal. Furthermore, while various advantages and features associated with certain embodiments of the disclosure have been described above in the context of those embodiments, other embodiments may also exhibit such advantages and/or features, and not all embodiments need necessarily exhibit such advantages and/or features to fall within the scope of the disclosure. Accordingly, the disclosure is not limited, except as by the appended claims.

I claim:

1. A method for identifying coins, the method comprising:
obtaining a sensor signal of a first coin;
generating a first contour signal at least in part from the sensor signal of the first coin;
identifying a first active interval in the first contour signal;
detecting a first coin feature from the first active interval;
obtaining a second sensor signal of a second coin;
generating a second contour signal at least in part from the sensor signal of the second coin;
identifying a second active interval in the second contour signal;
detecting a second coin feature from the second active interval; and
comparing the first and second coin features to corresponding features of known coin denominations,
wherein the first and second active intervals intersect.

2. The method of claim 1 wherein detecting the first coin feature includes detecting a pivot point.

3. The method of claim 1 wherein detecting the first coin feature further includes detecting an approach point.

4. The method of claim 1 wherein detecting the second coin feature further includes detecting a departure point.

5. The method of claim 2 wherein detecting the pivot point comprises detecting a slope of the first contour signal being zero or close to zero.

6. The method of claim 3 wherein detecting the approach point comprises detecting a second derivative of the first contour signal being zero or close to zero.

7. The method of claim 4 wherein detecting the departure point comprises detecting a second derivative of the second contour signal being zero or close to zero.

8. The method of claim 1 wherein generating the first and second contour signals includes generating digitized sensor signals.

9. The method of claim 1 wherein generating the first contour signal includes generating a digitized combination of at least two sensor signals.

10. The method of claim 1, further comprising determining a speed of the first coin from at least two first coin features.

11. The method of claim 1, further comprising determining an acceleration of the second coin using at least three second coin features.

12. The method of claim 3 wherein detecting the approach point includes determining a curvature of the first contour prior and after the approach point.

13. The method of claim 4 wherein detecting the departure point includes determining a curvature of the second contour prior and after the departure point.

14. The method of claim 1 wherein detecting the first second coin features includes using Boolean logic.

15. The method of claim 1, further comprising filtering the first and second contour signals using a digital filter.

16. A consumer operated coin counting apparatus comprising:

a coin input region configured to receive a plurality of coins;

a coin sensor configured to generate sensor signals corresponding to properties of a first coin and a second coin;

means for generating a first contour signal from the sensor signals of the first coin;

means for identifying a first active interval in the first contour signal;

means for determining at least a first coin feature in the first active interval;

means for comparing the first coin feature to a corresponding feature of a known coin denomination;

means for generating a second contour signal from the sensor signal of the second coin;

means for identifying a second active interval in the second contour signal;

means for determining at least a second coin feature in the second active interval;

means for comparing the second coin feature to a corresponding feature of a known coin denomination; and means for discriminating the first and second coins by comparing the first and the second coin features to corresponding features of at least one known coin, wherein the first and second active intervals intersect.

17. The apparatus of claim 16 wherein the means for determining at least one first coin feature include means for determining a pivot point of the first coin.

18. The apparatus of claim 16 wherein the means for determining at least one first coin feature further include means for determining an approach point of the first coin.

19. The apparatus of claim 16 wherein the means for determining at least one second coin feature further include means for determining a departure point of the second coin.

20. The apparatus of claim 16 wherein the means for generating the first and second contour signals include means for combining two or more sensor signals.

21. The apparatus of claim 16 wherein the means for generating the first and second contour signals include means for digitizing the sensor signals.

22. The apparatus of claim 17, further including means for digitally filtering the sensor signals.

23. The apparatus of claim 16, further comprising means for determining a speed of the first coin from at least two first coin features.

24. The apparatus of claim 16, further comprising means for determining an acceleration of the second coin from at least three second coin features.

25. The apparatus of claim 16 wherein the means for generating the first and second contour signals include means for digitizing the sensor signals.

26. The apparatus of claim 16 wherein the means for determining at least one first coin feature in the first active interval include Boolean logic implemented in computer code.

27. The apparatus of claim 16 wherein the means for determining at least one first coin feature in the first active interval include means for determining a curvature of the contour signal prior to and after the first coin feature.

28. A computer-readable medium whose contents cause a computer to discriminate coins, the coins being discriminated by a method comprising:

receiving multiple coins;

obtaining a first sensor signal of a first coins;

generating a first contour signal at least in part from the first sensor signal;

identifying a first active interval in the first contour signal;

detecting a first coin feature from the first active interval;

comparing the first coin feature to a corresponding feature of a known coin denomination;

obtaining a second sensor signal of a second coin;

generating a second contour signal at least in part from the second sensor signal;

identifying a second active interval in the second contour signal;

detecting a second coin feature from the second active interval; and comparing the second coin feature to a corresponding feature of a known coin denomination, wherein the first and the second active intervals intersect.

29. The computer readable medium of claim 28 wherein the method further comprises accepting or rejecting the first and second coins based on results of comparing the first and second coin feature to a corresponding features of known coin denominations.

30. The computer readable medium of claim 28 wherein detecting the first coin feature from the first active interval includes detecting a pivot point of the first coin.

31. The computer readable medium of claim 28 wherein detecting the second coin feature from the second active interval includes detecting an approach point of the second coin.

32. The computer readable medium of claim 28 wherein detecting the first coin feature from the first active interval includes detecting a departure point of the first coin.

33. The computer readable medium of claim 28 wherein detecting the first coin feature from the first active interval includes determining a curvature of the first contour signal prior to and after detecting the first coin feature.

34. A method for identifying coins, the method comprising:

obtaining a sensor signal of a coin;

generating a contour signal at least in part from the sensor signal;

identifying an active interval in the contour signal;

detecting a coin feature from the active interval, wherein detecting a coin feature further includes detecting a departure point, and wherein detecting the departure point includes using Boolean logic characterized by:

$i_{departures}\{i:(a_i>0)\hat{}(b_i<0)\hat{}(f_i<0)\hat{}(c_i<0)\hat{}(n_i\geq 0)\}$ ; and comparing the coin feature to a corresponding feature of a known coin denomination.

35. The method of claim 34 wherein the coin is a first coin, wherein the sensor signal is a first sensor signal, wherein the active interval is a first active interval, and wherein the method further comprises:

determining a second active interval in the contour signal, the second active interval corresponding to a second sensor signal of a second coin;

detecting a second coin feature from the second active interval; and comparing the second coin feature to the corresponding feature of the known coin denomination.

36. The method of claim 34 wherein detecting the coin feature includes detecting a pivot point.

37. The method of claim 34 wherein detecting the coin feature further includes detecting an approach point.

38. The method of claim 34 wherein detecting the coin feature further includes detecting a departure point.

39. The method of claim 34 wherein generating the contour signal includes generating a digitized combination of at least two sensor signals.

40. A method for identifying coins, the method comprising:

obtaining a sensor signal of a coin;

generating a contour signal at least in part from the sensor signal;

identifying an active interval in the contour signal;

detecting a coin feature from the active interval, wherein detecting a coin feature further includes detecting an approach point, and wherein detecting the approach point includes using Boolean logic characterized by:

$i_{arrivals}\{i:(a_i>0)\hat{}(b_i>0)\hat{}(f_i>0)\hat{}(c_i<0)\hat{}(p_i\geq 0)\}$;

; and comparing the coin feature to a corresponding feature of a known coin denomination.

41. The method of claim 40 wherein detecting the coin feature comprises detecting a slope of the contour signal being zero or close to zero.

42. The method of claim 40 wherein detecting the coin feature comprises detecting a second derivative of the contour signal being zero or close to zero.

43. The method of claim 40, further comprising determining a speed of the coin from at least two coin features.

44. A method for identifying coins, the method comprising:

obtaining a sensor signal of a coin;

generating a contour signal at least in part from the sensor signal;

identifying an active interval in the contour signal;

detecting a coin feature from the active interval, wherein detecting a coin feature further includes detecting a pivot point, and wherein detecting the pivot point includes using Boolean logic characterized by:

$i_{pivots}\{i:(a_i>0)\hat{}(b_i>0)\hat{}(f_i\leq 0)\hat{}(c_i<0)\}$

; and comparing the coin feature to a corresponding feature of a known coin denomination.

45. The method of claim 44 wherein detecting the coin feature comprises detecting a second derivative of the contour signal being zero or close to zero.

46. The method of claim 44, further comprising determining an acceleration of the coin using at least three coin features.

* * * * *

UNITED STATES PATENT AND TRADEMARK OFFICE

CERTIFICATE OF CORRECTION

PATENT NO. : 8,668,069 B1
APPLICATION NO. : 13/691047
DATED : March 11, 2014
INVENTOR(S) : Daniel D. Everhart It is certified that error appears in the above-identified patent and that said Letters Patent is hereby corrected as shown below:

In the Claims

In column 16, line 26, in claim 28, delete "coins;" and insert -- coin; --, therefor.

Signed and Sealed this
Twenty-second Day of July, 2014

Michelle K. Lee

Michelle K. Lee
*Deputy Director of the United States Patent and Trademark Office*